US011306449B2

(12) United States Patent
Wigley et al.

(10) Patent No.: US 11,306,449 B2
(45) Date of Patent: Apr. 19, 2022

(54) SPOOL-LESS SYSTEM FOR DEPLOYMENT, RECOVERY, AND MANIPULATION OF A TRAVERSABLE ROAD COVERING TRACK

(71) Applicant: Faun Trackway Limited, Wales (GB)

(72) Inventors: Neil Wigley, Wales (GB); Paul Godridge, Wales (GB); Dafydd Roberts, Wales (GB)

(73) Assignee: FAUN TRACKWAY LIMITED, Llangefni (GB)

( * ) Notice: Subject to any disclaimer, the term of this patent is extended or adjusted under 35 U.S.C. 154(b) by 0 days.

(21) Appl. No.: 17/017,659

(22) Filed: Sep. 10, 2020

(65) Prior Publication Data

US 2021/0079602 A1 Mar. 18, 2021

(30) Foreign Application Priority Data

Sep. 13, 2019 (GB) ..... 1913238

(51) Int. Cl.
*E01C 19/52* (2006.01)
*E01C 5/00* (2006.01)

(52) U.S. Cl.
CPC ..... *E01C 19/522* (2013.01); *E01C 5/00* (2013.01)

(58) Field of Classification Search
CPC ... E01C 19/522; B65H 16/005; B65H 16/028; B65H 16/08; B65H 2301/4137; B65H 2301/41429; B65H 2301/41722; B65H 2701/18422; B65H 2701/1922; B66F 9/184
See application file for complete search history.

(56) References Cited

U.S. PATENT DOCUMENTS 908,954 A * 1/1909 Channon ..... E04F 10/0677 242/595.1
997,491 A * 7/1911 Daus ..... E04F 10/0677 242/595.1
1,020,246 A * 3/1912 Baker ..... E04F 10/0677 242/595.1
1,111,590 A * 9/1914 Jacobs ..... E04F 10/0677 242/595.1

(Continued)

OTHER PUBLICATIONS

UK Search Report under Section 17, dated Dec. 12, 2019 in connection with GB1913238.0.

*Primary Examiner* — Gary S Hartmann
(74) *Attorney, Agent, or Firm* — Quarles & Brady LLP

(57) ABSTRACT

A spool-less system for deployment, recovery and manipulation of a traversable road covering track. The system includes an arcuate guide member detachably coupled to a retaining member; the guide member and retaining member defining a volume for receiving a roll of traversable road covering; the guide member arranged to contact the roll along a first arcuate range and the retaining member configured to contact the roll along a second arcuate range; and wherein the guide member and retaining member are detachably coupleable having, a first position in which, the guide member and retaining member are separated at a first diameter whereby the roll of traversable road covering may be deployed or recovered when the host machine is in motion, and a second position in which, the guide member and retaining member are separated at a second diameter in which the roll of traversable road covering is retained.

16 Claims, 20 Drawing Sheets

(56) References Cited

U.S. PATENT DOCUMENTS

| | | | | |
|---|---|---|---|---|
| 2,134,656 | A * | 10/1938 | Breth | B65H 16/08<br>242/595.1 |
| 3,643,885 | A | 2/1972 | Keesling et al. | |
| 4,044,907 | A | 8/1977 | Craft | |
| 5,129,462 | A * | 7/1992 | Mail | A01G 20/18<br>172/19 |
| 7,182,287 | B2 * | 2/2007 | Denker | B21C 47/24<br>242/533.3 |
| 2009/0107348 | A1 | 4/2009 | Noonan | |
| 2014/0291433 | A1 | 10/2014 | Owegeser | |

* cited by examiner

SPOOL-LESS SYSTEM FOR DEPLOYMENT, RECOVERY, AND MANIPULATION OF A TRAVERSABLE ROAD COVERING TRACK

The present application is based on, claims priority to, and incorporates herein by reference in its entirety GB 1913238.0 filed Sep. 13, 2019, entitled "Traversable Road Covering Track."

TECHNICAL FIELD

The present invention relates to apparatus, systems and methods of spool-less deployment, recovery and manipulation of rollable roadway panels.

BACKGROUND

Expedient roadway surfacing provides the ability to move into and out of areas of opportunity by providing logistics routes for vehicles which could not otherwise cross problematic ground conditions. Many industries—such as construction and energy, require ad hoc access for machinery under such situations. One method of providing this capability is via a rollable system of interconnected panels which can be rolled out over a required traffic route, as well as rolled up for recovery and transport.

However, current modes of dispensing suitable rollable road panels are either expensive and a logistical burden, or inefficient and require appreciable manual effort to deploy and recover. In addition, for the mechanical systems to operate require auxiliary components such as spools, chains etc. which add both weight and complexity to the system as well as added secondary considerations such as higher maintenance planning and cost, the requirement to move and store these auxiliary components when not in use, etc.

SUMMARY

The present invention is a system that provides a method for both deployment and recovery of the roll up road surfacing without the need for these auxiliary components. In addition, it also provides the ability to lift and manipulate these rolls—current systems known to the art do not permit this function, which must be provided by a second system such as a loader or crane.

By addressing the issues identified above, the system allows for simpler, safer and more economic use of the roll up roadway and the host plant vehicle while also providing a much greater operational flexibility which is of value during civilian and military operations.

According to an embodiment of the invention there is provided a spool-less system for deployment, recovery and manipulation of a traversable road covering track, the system being detachably coupleable to a host machine for providing operating power and transportation, the system comprising: an arcuate guide member detachably coupled to a retaining means; the guide member and retaining means defining a volume for receiving a roll of traversable road covering; the guide member arranged to contact the roll along a first arcuate range and the retaining means configured to contact the roll along a second arcuate range; and wherein the guide member and retaining means are detachably coupleable having, a first position in which, the guide member and retaining means are separated at a first diameter whereby the roll of traversable road covering may be deployed or recovered when the host machine is in motion, and a second position in which, the guide member and retaining means are separated at a second diameter in which the roll of traversable road covering is retained.

Advantageously, the system can provide the functions of deployment, recovery and manipulation without the need for a central spool/winding unit. This both increases the logistical efficiency of using rollable road panels as well as decreases costs and payload weight significantly.

Additionally, as an alternative to the ability to 'push' out a roll of rollable road panels and recovering the panels by pushing from the opposite direction, the system allows recovery via 'pulling', allowing the rollable road panels to be recovered while the host vehicle is on the mat itself. This allows recovery of the mat without putting the host vehicle on the subgrade itself.

The system provides for the deployment and recovery (rolling) function without any rotational effort being applied to the rollable road panels themselves (i.e. no motors, chains and straps).

The system can provide a controlled deployment whereby the roll can be laid on inclines—the overreaching arms providing a stop to negate a wound up spool rolling away downhill. This improves safety and overall functionality.

The system can provide a grab function. Not only does this allow manipulation of a roll, but also negates the need for dedicated dispensers for different panels. As such the system can provide universal functionality across a broader range of rollable and general materials.

Due to the serious weight savings possible by the system, rollable road panels can be used by more (and lighter duty) host vehicles which potentially opens up otherwise restricted markets.

In an embodiment the guide member comprises a plurality of rollers configured into an arcuate array.

In an embodiment the plurality of rollers are disposed on a body, the plurality of rollers and body defining an arm.

In an embodiment the system further comprises a mounting frame detachably coupleable to the host machine and the arm detachably coupleable to the mounting frame. The system can be constructed modularly to fold down into a smaller space when not in use, requiring less space for transportation and greater options for logistics.

In an embodiment the mounting frame comprises a substantially horizontal elongate member.

In an embodiment the system further comprises a second arm.

In an embodiment the first arm and second arm are located towards opposite horizontal ends of the mounting frame.

In one embodiment the retaining means comprises a second plurality of rollers configured into an arcuate array, the second plurality of rollers are disposed on a body defining a distal portion of an arm.

In an embodiment the system comprises a connection means, connecting the guide member with the retaining means.

In an embodiment the connection means, comprises a pivot point around which the second arcuate member rotates, thereby varying the diameter of the volume.

In an embodiment the system further comprising an arm actuator to actuate the retaining means and thereby the system into the first position and the second position.

In an embodiment the distal portion of the arm further comprises a diameter limiting member configured to contact the roll of traversable road covering until it is fully deployed. The limiting member aids in achieving a consistent roll diameter for a given length when recovering. The system can optionally be fitted with a constant tension star wheel which keeps the rollable road panels under tension when deploying.

In an embodiment the diameter limiting member is pivotally attached to an inner surface of the distal portion the arm.

In an embodiment the diameter limiting member further comprises a limiting member actuator to actuate the pivoting motion.

In an embodiment the diameter limiting member is resiliently biased to provide a consistent pressure against the roll of traversable road covering.

In an alternative embodiment the retaining means comprises a length of strap detachably coupleable to the roll of traversable road covering.

In an embodiment the guide member further comprises strap guides for locating the strap.

In an embodiment the system further comprises a drum connectable to the strap and around which the strap may be wound.

In an embodiment the drum comprises a motor to drive a winding motion of the drum.

In an embodiment the system further comprises a locking means for retaining a recovered/undeployed roll of traverasable road covering in the volume.

According to a further embodiment there is provided a host machine having mounted thereon a spool-less system as described according to the previous embodiment, the spool less system being arranged to deploy a traversable road covering track while the host machine travels in a first direction upon the deployed traversable road covering track, and to recover the traversable road covering track while the host machine travels in a second direction upon the deployed traversable road covering.

According to a further embodiment there is provided a method of deployment, recovery and manipulation of a traversable road covering track comprising the steps: detachably coupling a spool-less system as described according to the previous embodiment to a host machine; and operating the host machine to recover and deploy the traversable road covering track while the host machine travels upon at least a portion of the traversable road covering.

BRIEF DESCRIPTION OF THE DRAWINGS

The invention may be performed in various ways and an embodiment thereof will now be described, by way of example only, reference being made to the accompanying drawings, in which:—

DETAILED DESCRIPTION

Figure 1:
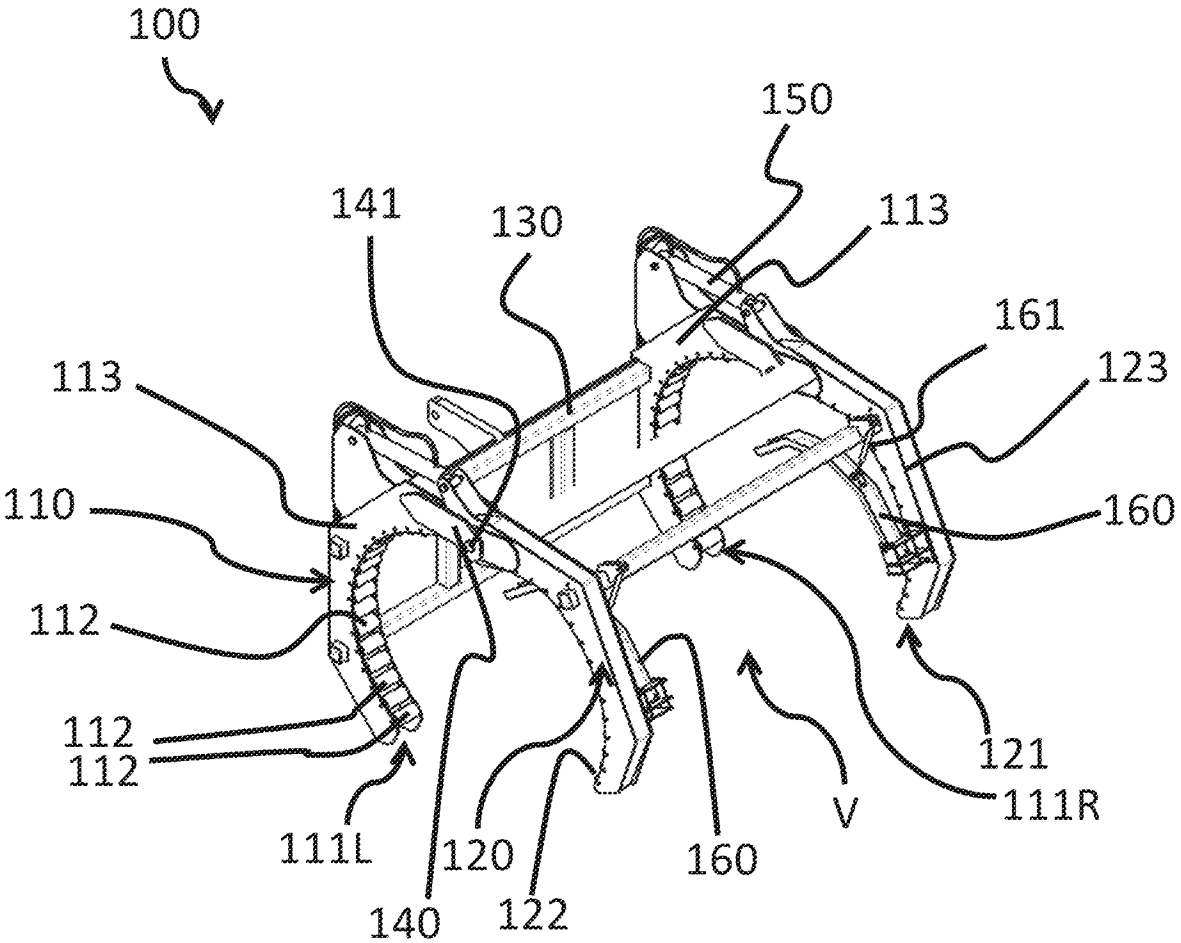
FIG. 1 is an isometric view of the system according to one embodiment of the present invention.
Figure 2:
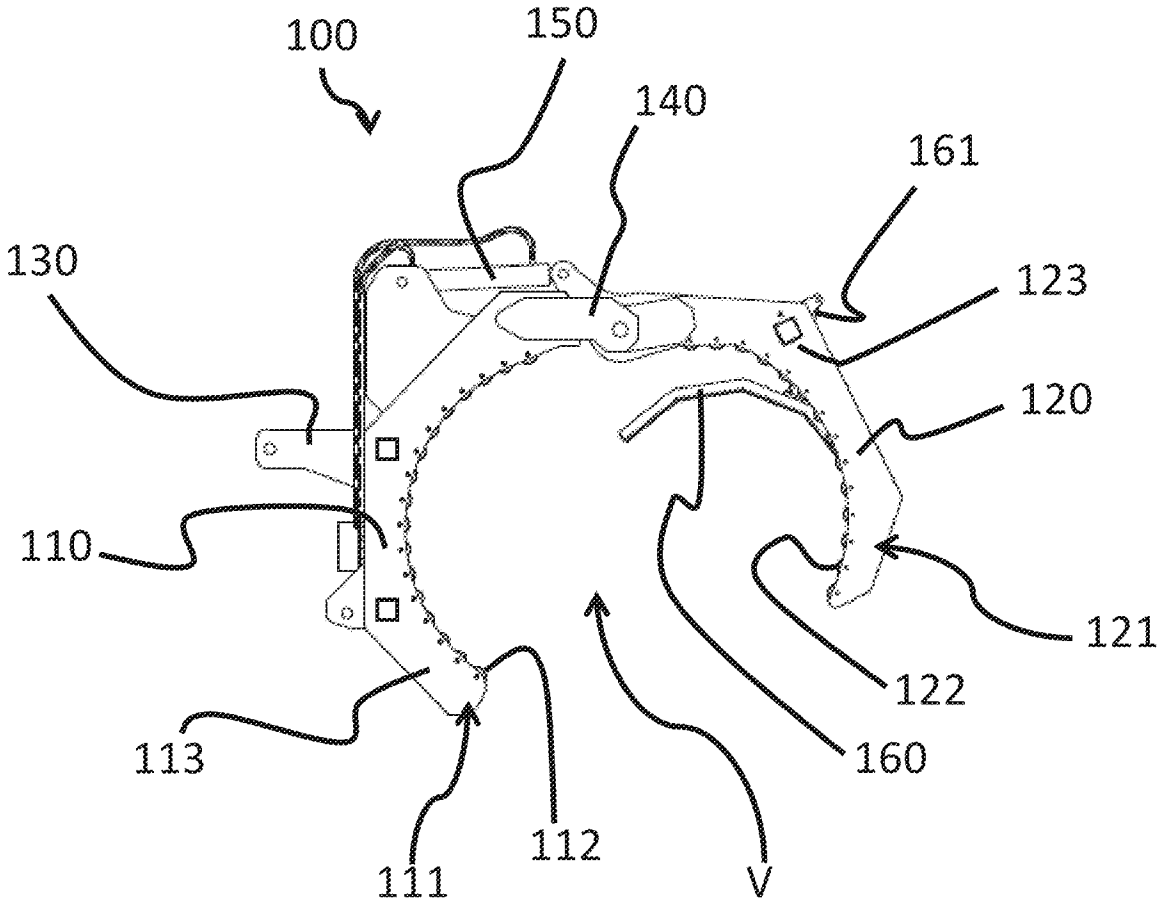
FIG. 2 is a side view of the system as shown in FIG. 1.

Referring to FIGS. 1 and 2 of the drawings, there is shown a spool-less system (100) according to one embodiment of the present invention. In this embodiment the system comprises a mounting frame (130) and two sets of jaws. Each jaw comprising an arm (111L/111R) and a distal arm portion (121). Between each jaw is defined a volume (V) to receive a roll of track (not shown). The arms comprise a guide member (110), having a body (113) and a plurality of roller (112) disposed within the body in a substantially arcuate arrangement. The construction of the distal arm portion (121) in this embodiment is near identical to the arm (111). The distal arm portions (121) comprises a retaining means (120), having a body (123) and a plurality of roller (122) disposed within the body in a substantially arcuate arrangement. The arm (111) and distal arm portion (121) are connected by a connection means (140), in the embodiment shown as a bracket, the connection means includes a pivot (141) point about which the distal arm portion rotates with respect to the arm (111) thereby varying the diameter of the volume (V). Arm actuators (150) are shown, which are powered by the host machine, and shown as linear hydraulic pumps/cylinders. The distal arm portions further comprise diameter limiting members (160), these extend inward into the volume to contact the track roll. The diameter limiting members (160) comprise an arcuate body, connected to the distal arm portion (121) at a connection point and by a diameter limiting member actuator (161). There are additional manufacturing features shown on the embodiment, such as apertures, securing and location means.

The mounting frame comprises a substantially horizontal elongate member. In the embodiment shown there are multiple additional reinforcement bars forming part of the mounting frame and a connection point for attaching to a host vehicle (not shown). Various shapes of mounting frame are envisaged suitable for multiple vehicles. The connection point/(s) can be any suitable means. The host machine may provided power and transportation for the system, however, it could be conceived that power is supplied on the system itself or a system unpowered using resilient bias. Additionally reinforcing crossbars are shown between the sets of jaws, between the connection means (140) and diameter limiting members (160) on the distal arm portions (121).

Figure 3:
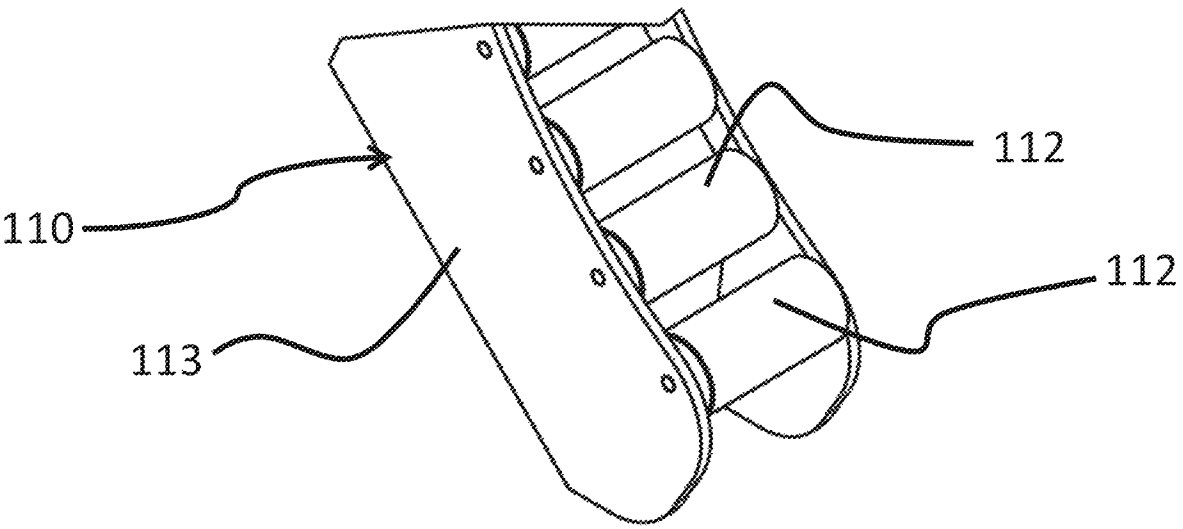
FIG. 3 is a close up view of the rollers of the system as shown in FIG. 1.

FIG. 3 shows a close up view of the rollers (112) of the guide member (110). The push rollers (112/122) shown in the embodiment are cylindrical, they provide a force while minimising roll resistance. Alternative shapes with curved surfaces could be used. The rollers are disposed within the body (113) of the guide at fixed positions, such that only a portion of the roller protrudes from the body. Alternative embodiments are envisage where the rollers can help minimise roll resistance depending on the construction of the arm (111/121), for example the rollers may be placed on an internal or external surface of the body, as long as they provide the push force and reduce resistance to the track roll (70).

Figure 4:
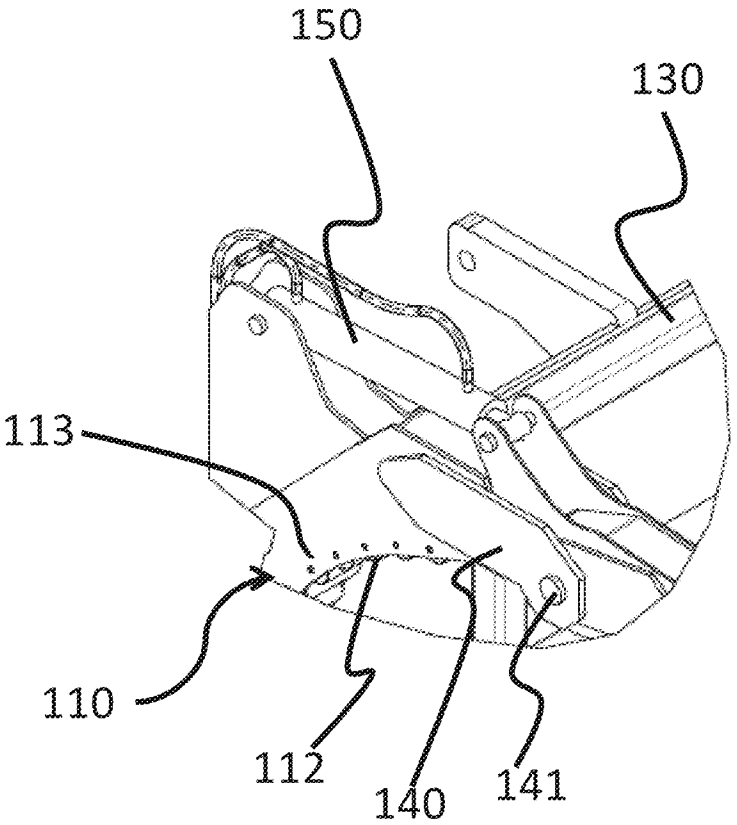
FIG. 4 is a close up view of the actuator for the retaining means of the system as shown in FIG. 1.
Figure 5:
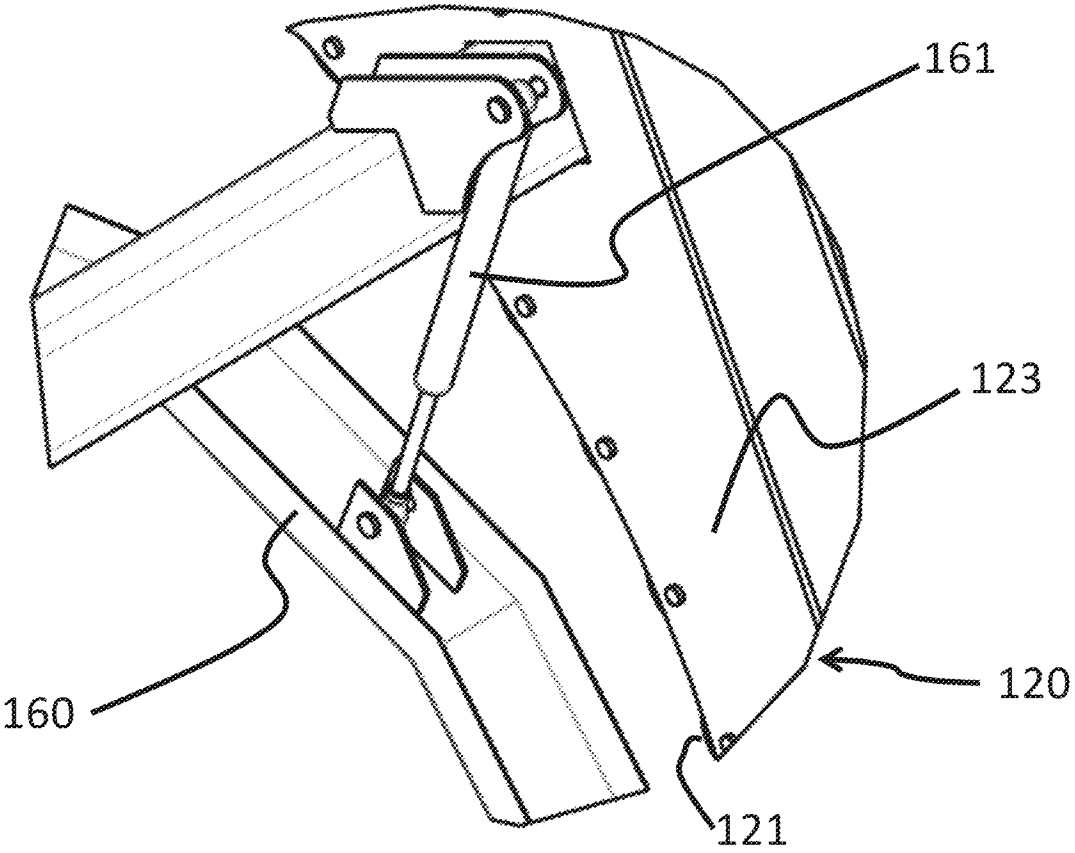
FIG. 5 is a close up view of the diameter limiting member of the system as shown in FIG. 1.
Figure 6:
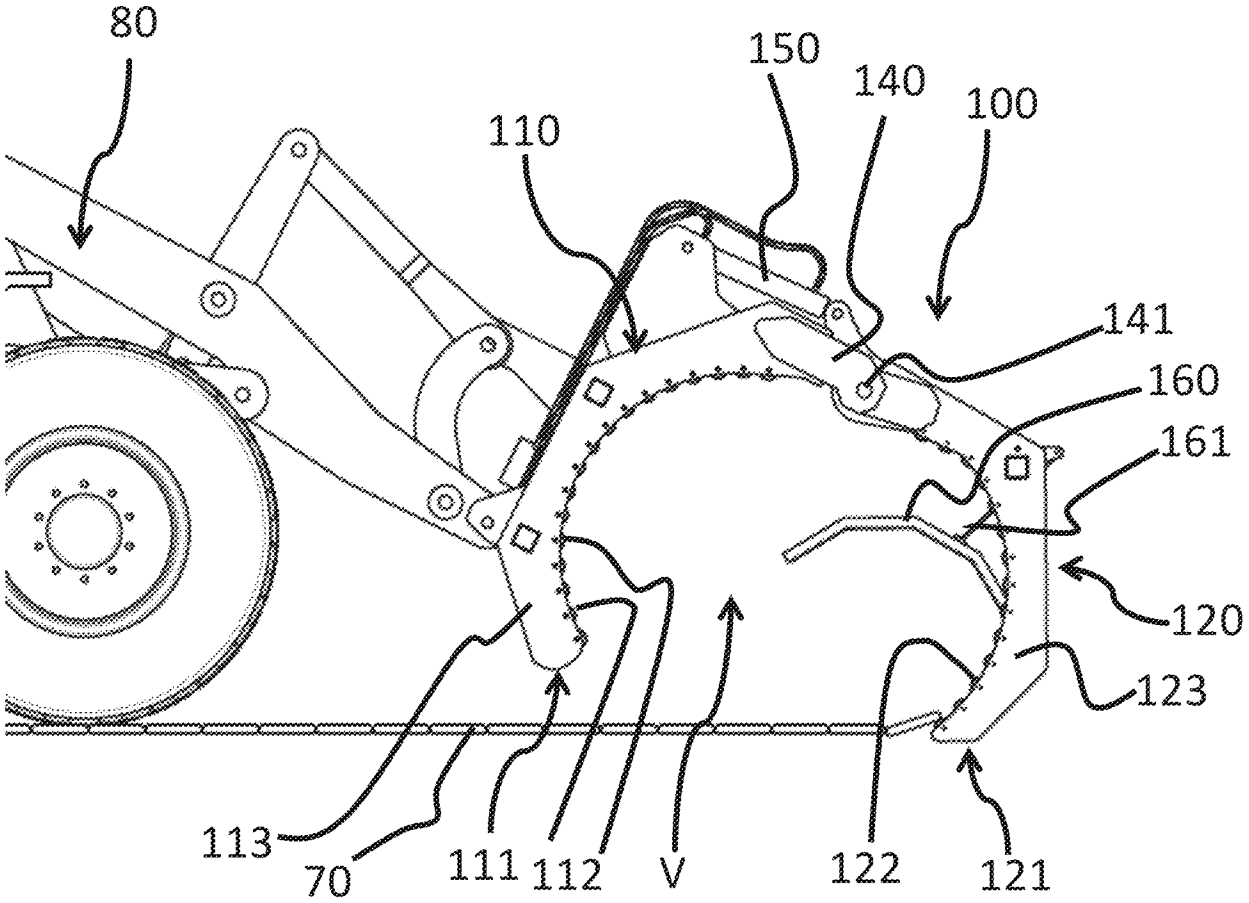
FIG. 6 is an illustration of the system according to one embodiment of the present invention in use at the beginning of a recovery phase or end of a deployment phase.
Figure 7:
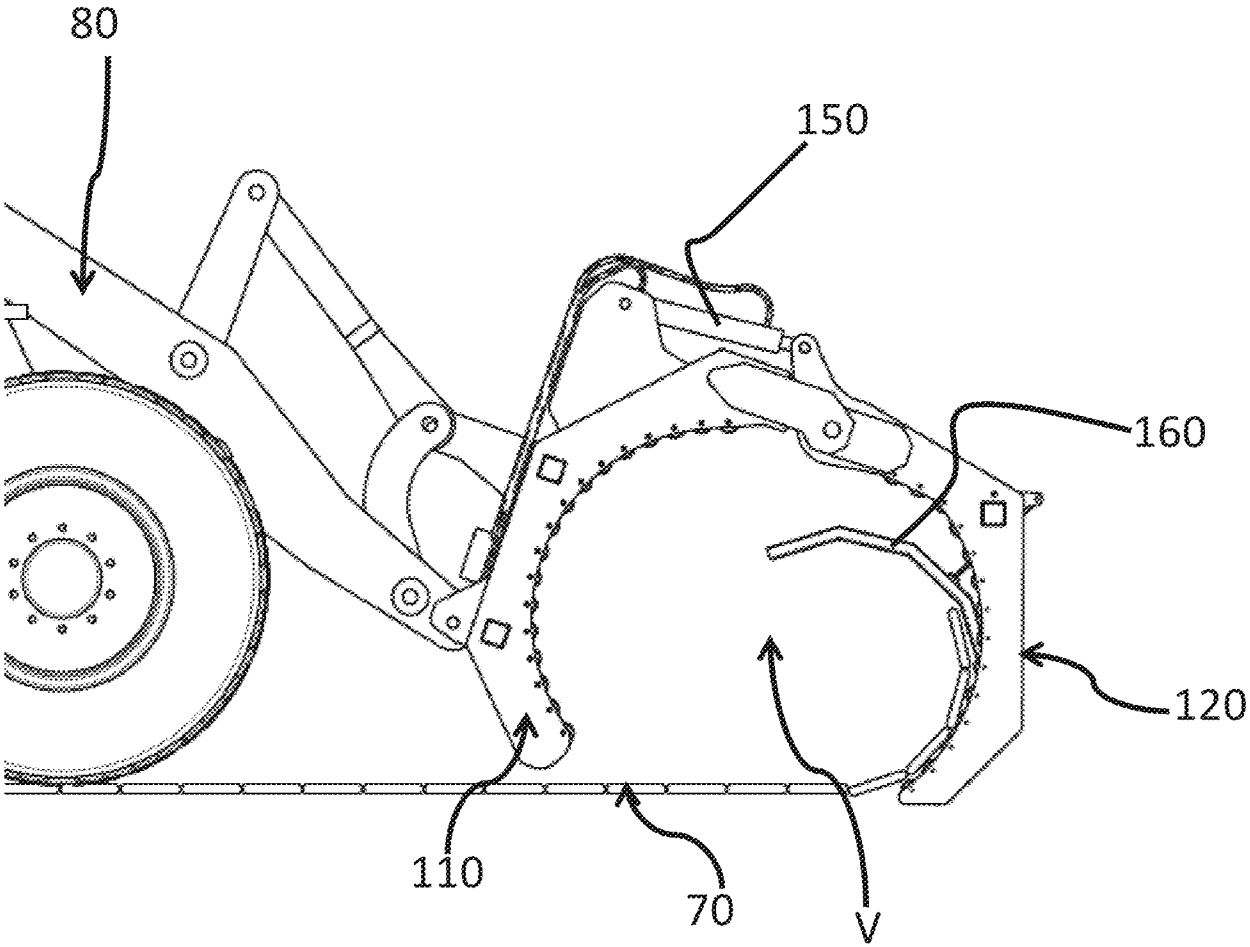
FIG. 7 is an illustration of the system as shown in FIG. 6 in use at an intermediate position of a recovery phase or a deployment phase.
Figure 8:
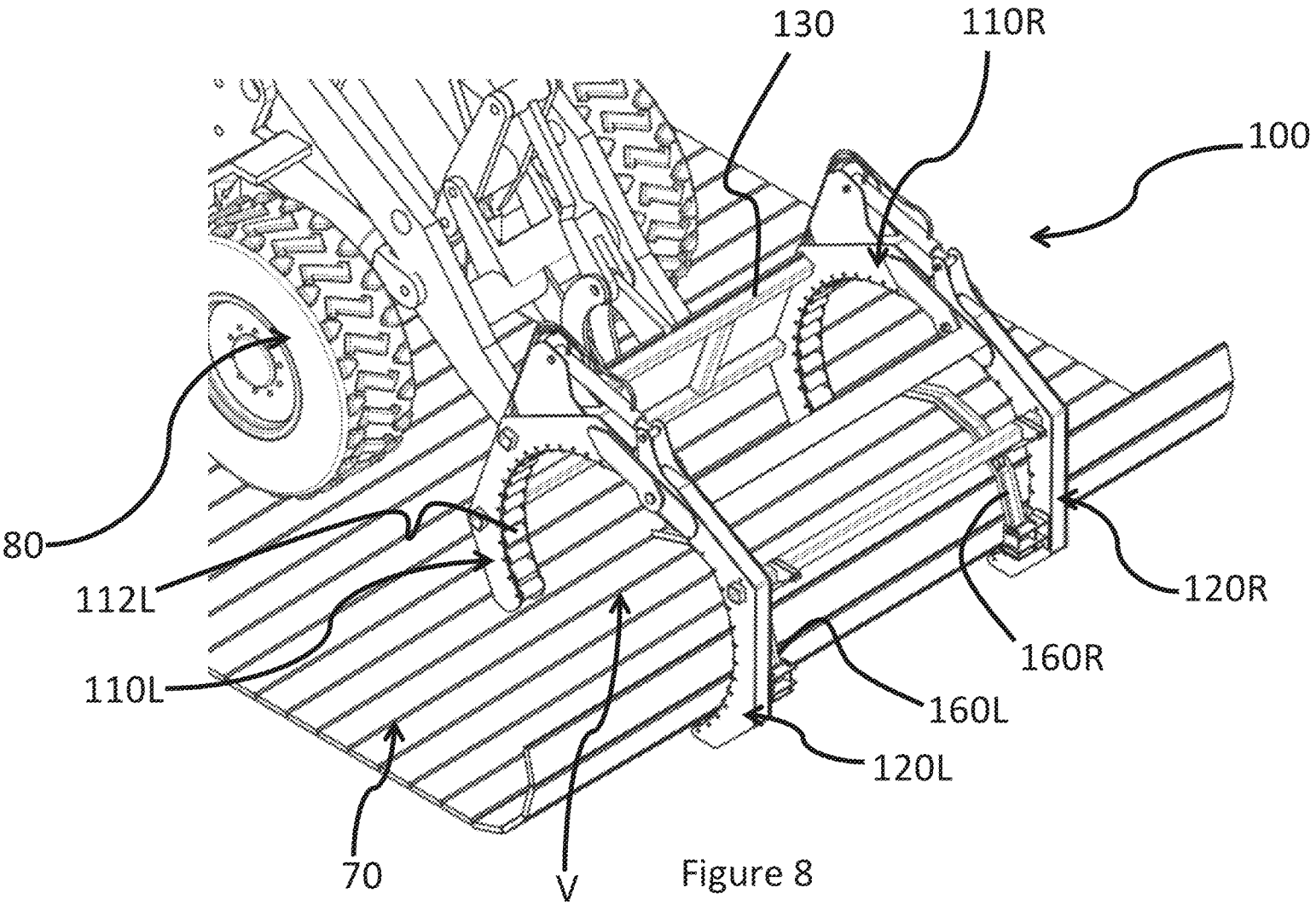
FIG. 8 is an isometric view illustration of the system as shown in FIG. 7.
Figure 9:
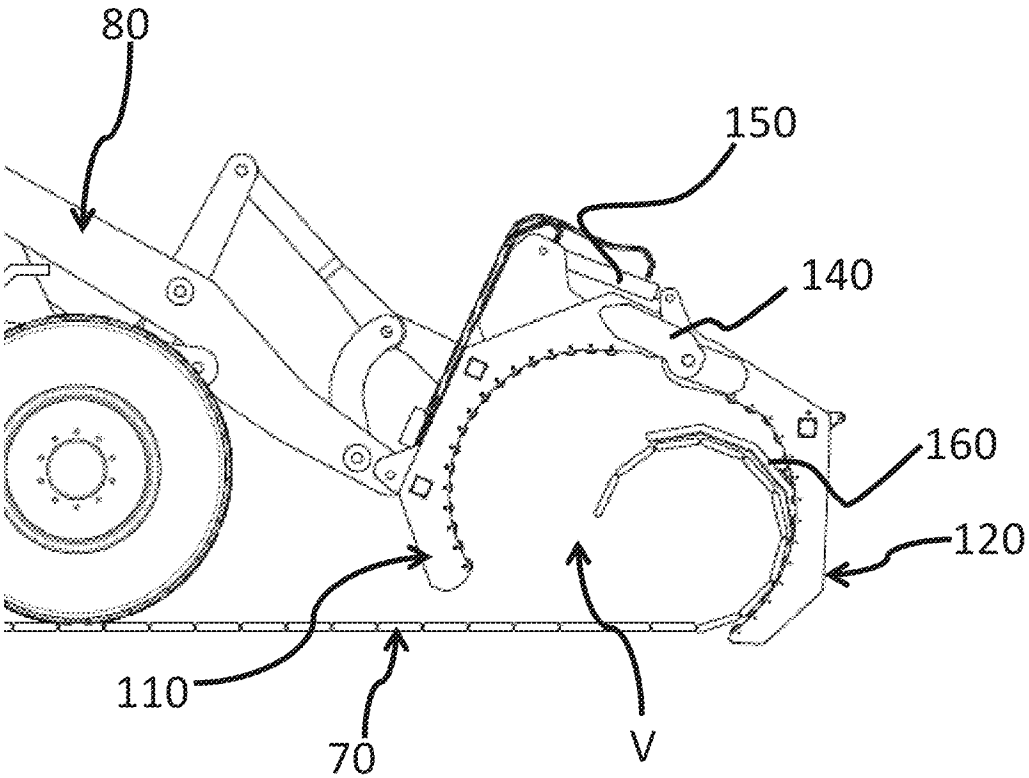
FIG. 9 is an illustration of the system as shown in FIG. 6 in use at an intermediate position of a recovery phase or a deployment phase.
Figure 10:
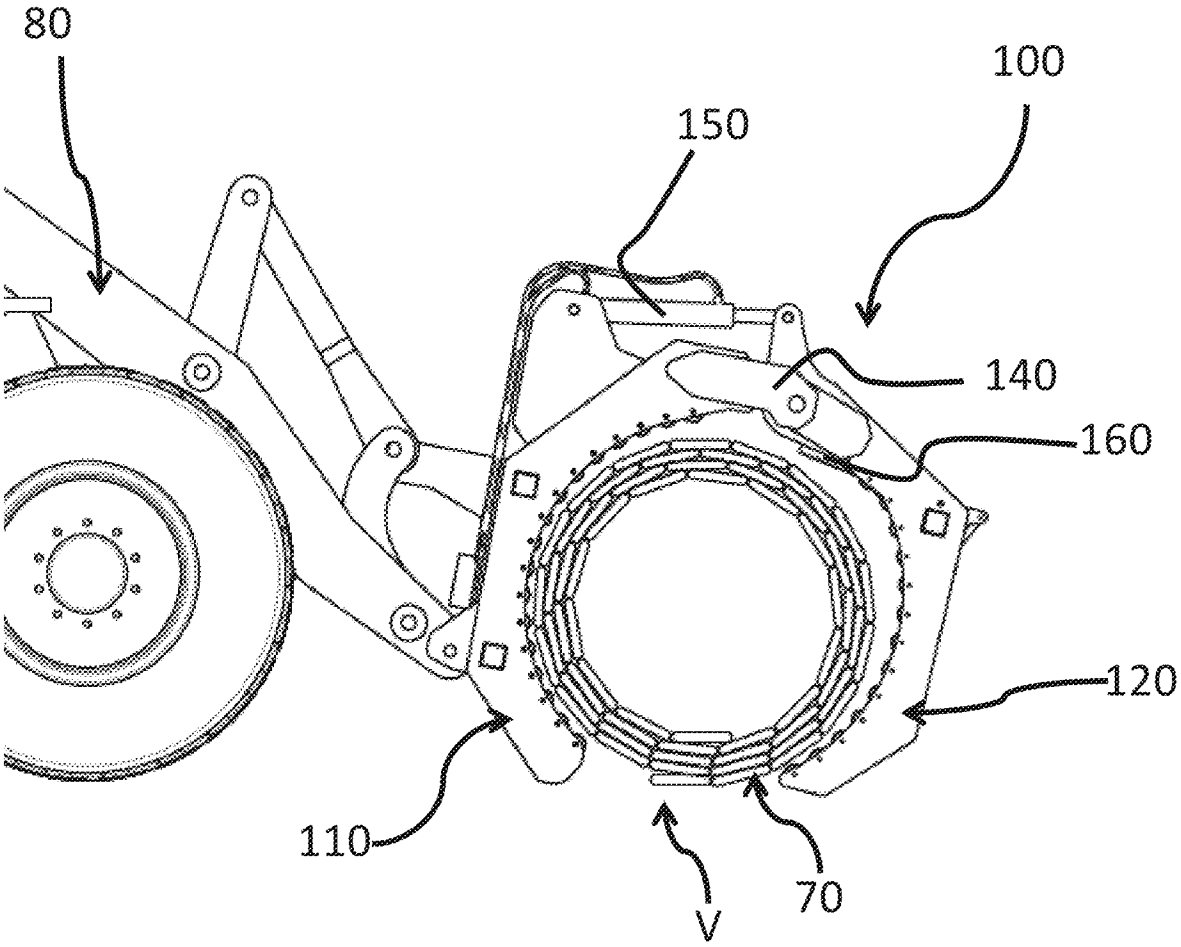
FIG. 10 is an illustration of the system as shown in FIG. 6 in use at a recovered phase or an un-deployed phase.
Figure 11:
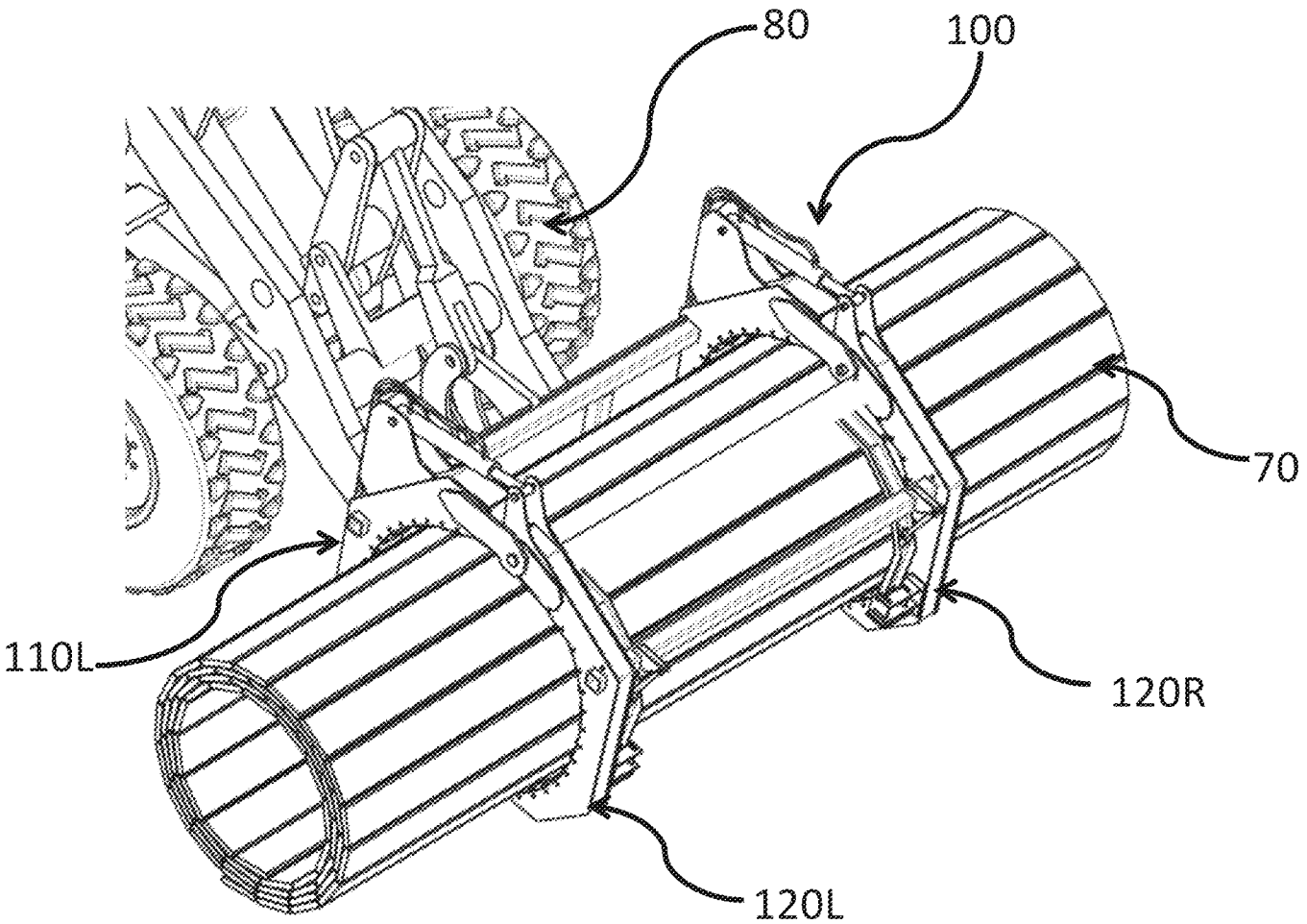
FIG. 11 is an isometric view illustration of the system as shown in FIG. 10.
Figure 12:
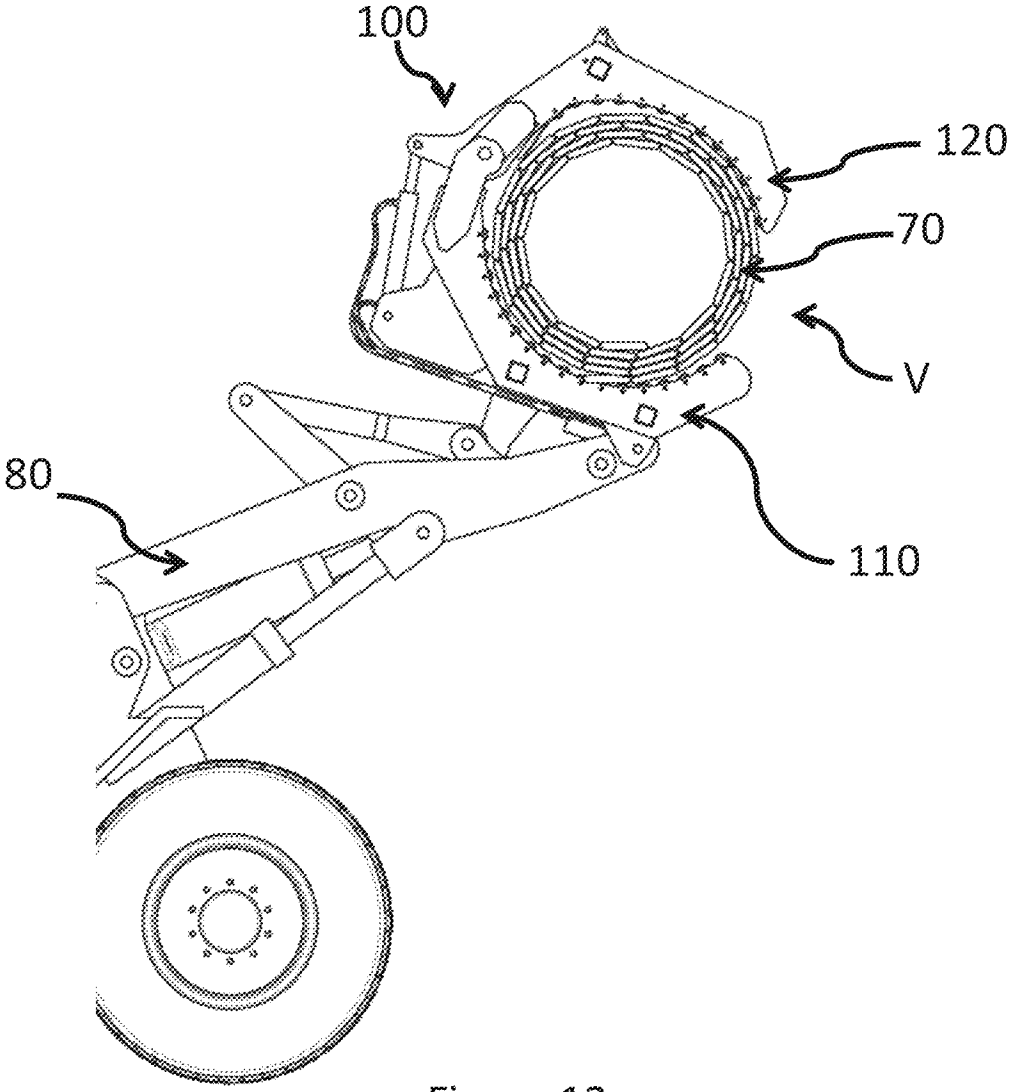
FIG. 12 is an illustration of the system as shown in FIG. 6 in use at a lifted phase.

FIG. 4 shows a close up view of the actuator (150) for the retaining means (120). FIG. 5 shows a close up view of the limiting member actuator (161) of the diameter limiting member (160), disposed on the retaining means (120). Both the arm actuator and diameter limiting actuator are shown as linear hydraulic pumps/cylinders, however different actuator means such as electrically driven or resilient biasing mechanisms are envisaged.

All the features in this embodiment are detachably coupleable allowing for easy disassembly, storage and transport. It is envisaged that there may be embodiment were certain features are formed integrally.

Shown in FIGS. 6 to 12 are views of the system (100) attached to a host machine (80) and loaded with a track roll (70), in different stages of deployment, recovery, manipulation and transportation.

In an example of use of the embodiment, the system (100) accommodates four main uses; deployment, recovery, manipulation and transportation. During deployment the host machine (80) provides hydraulic power to various actuators (150/160) located on the system (100) that allow changes in orientation and angle of the mounting frame (130) and arms (111/121). During deployment, the system is oriented so as to entrap the roll (70) inside the volume of influence (V). At this point the host machine drives forward, allowing the push-rollers (112) to apply a pushing force to the roll. Importantly, the rollers provide a force while minimising roll resistance as would be present if using a simple beam or pad. The host machine then drives out the roll, with braking/stop functionality provided by the opposite pull arms (121) and optionally the diameter limiting member (160). During recovery: the system (100) is initially positioned at an angle where the pull arms (121) may be presented below the road panel mat (70) level to promote rolling. This is mostly applicable on deformable subgrades such as marshes, bogs or un-prepared soils and sands. On concrete or asphalt, an operator may present the first panel of the roll at an angle which will achieve the same effect. The host machine, being on the road panel mat itself, reverses. The pull arms (121L/121R) translate this movement into a force, which in turn rolls the rollable road panels (70) along the path of the arm curvature. The optional roll tension device (160) assistance while the roll begins to roll down the push-side/arm (112) of the volume. As such it provides a controlled force at the downward roll end of the regardless of the position of the push-side rollers. Once the first wrap has been established, the host vehicle needs only reverse and control the position of various arms to control the volume to recover the rollable road panel mat. During manipulation: the volume (V) is collapsed inwardly, the arms rotating inwardly around the pivot (141) reducing the distance between the guide member (110) and retaining means (120) which in effect grabs the roll in its entirety. This grab function provides the ability to lift and move the roll as needed, including for storage or loading onto flatbeds, frames, stillages etc. This greatly improves the flexibility of deployment options open to the user. During transportation: when the system (100) is required independently of the host machine (80), the system can be constructed to be foldable so as to reduce the volume and footprint required to move the system. This is achieved whereby the boom and pull arms which are integral to creating the volume of influence can be unlocked and rotated to a park position. This effectively allows the whole assembly to concertina down to a flat package, allowing the dimensions to be configured to standard modes of transport (ISO containers, 463L air freight, etc.)

Figure 13:
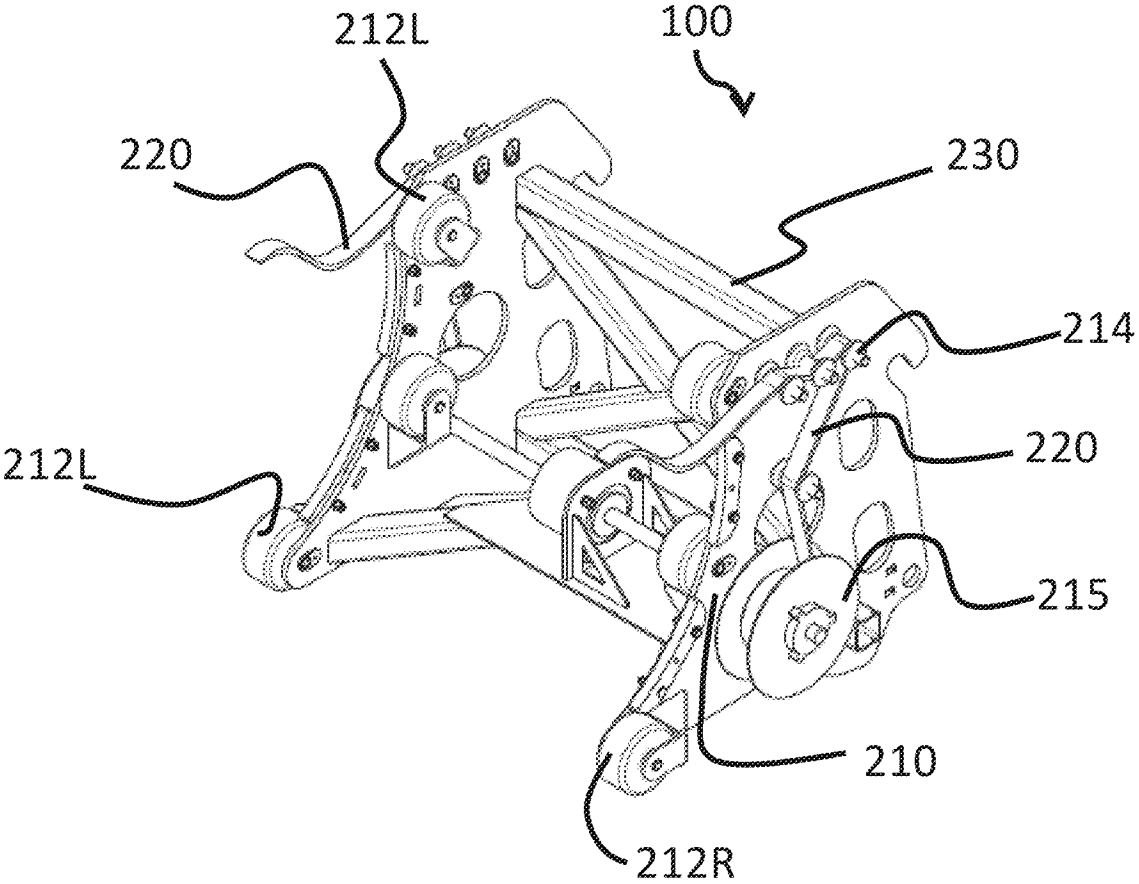
FIG. 13 is an isometric view of the system according to an alternative embodiment of the present invention.
Figure 14:
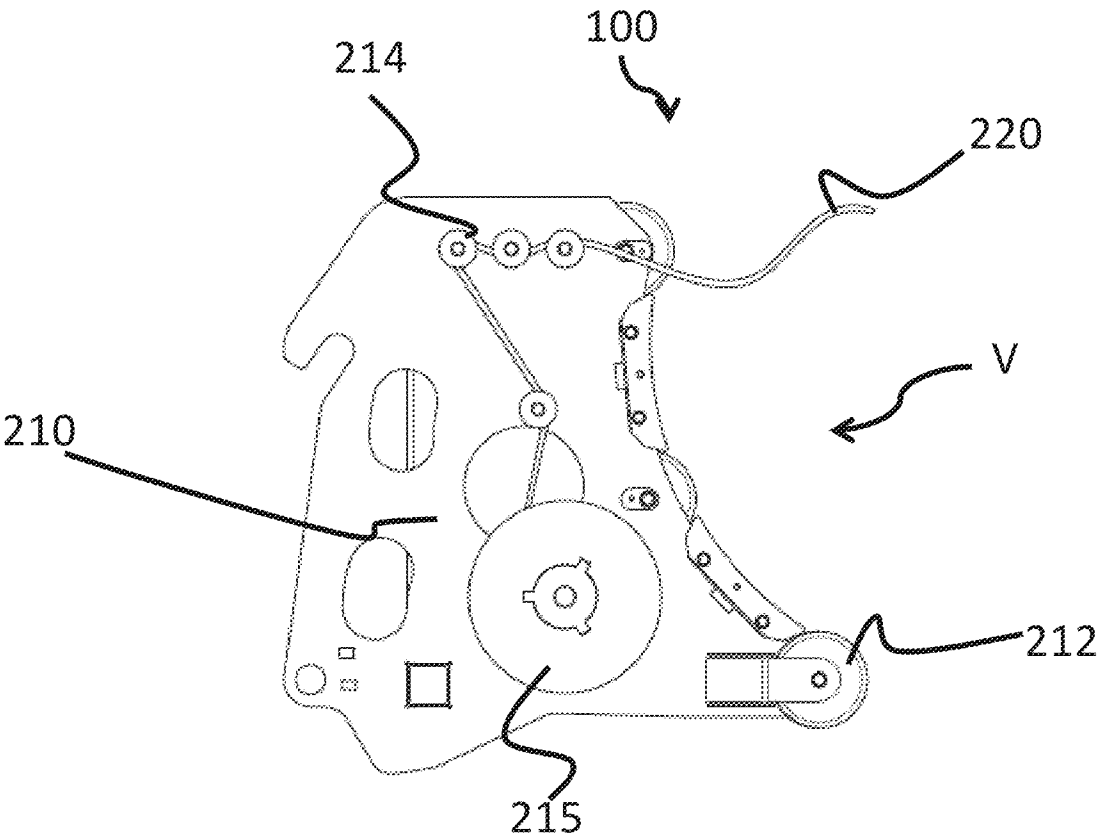
FIG. 14 is a side view of the system as shown in FIG. 13.

Referring to FIGS. 13 and 14 there is shown a spool-less system (100) according to an alternative embodiment of the present invention. In this embodiment the system comprises two guide members (210) either side of a mounting frame (230). Further more the retaining means (120) is provided as straps (220). Between the straps (220) and guide member is defined a volume to receive a roll of track (not shown). The guide member (110) comprise, an arcuate body and a plurality of roller (212) disposed on the body in a substantially arcuate arrangement. The guide member further comprise strap guides (214) for locating the retaining means straps (220) and a drum (215) to which the straps can be wound when the roll is undeployed. The straps (220) may be any length of flexible material which can be coupled to the guide member and/or the track roll. There are additional manufacturing features shown on the embodiment, such as apertures, securing and location means.

Figure 15:
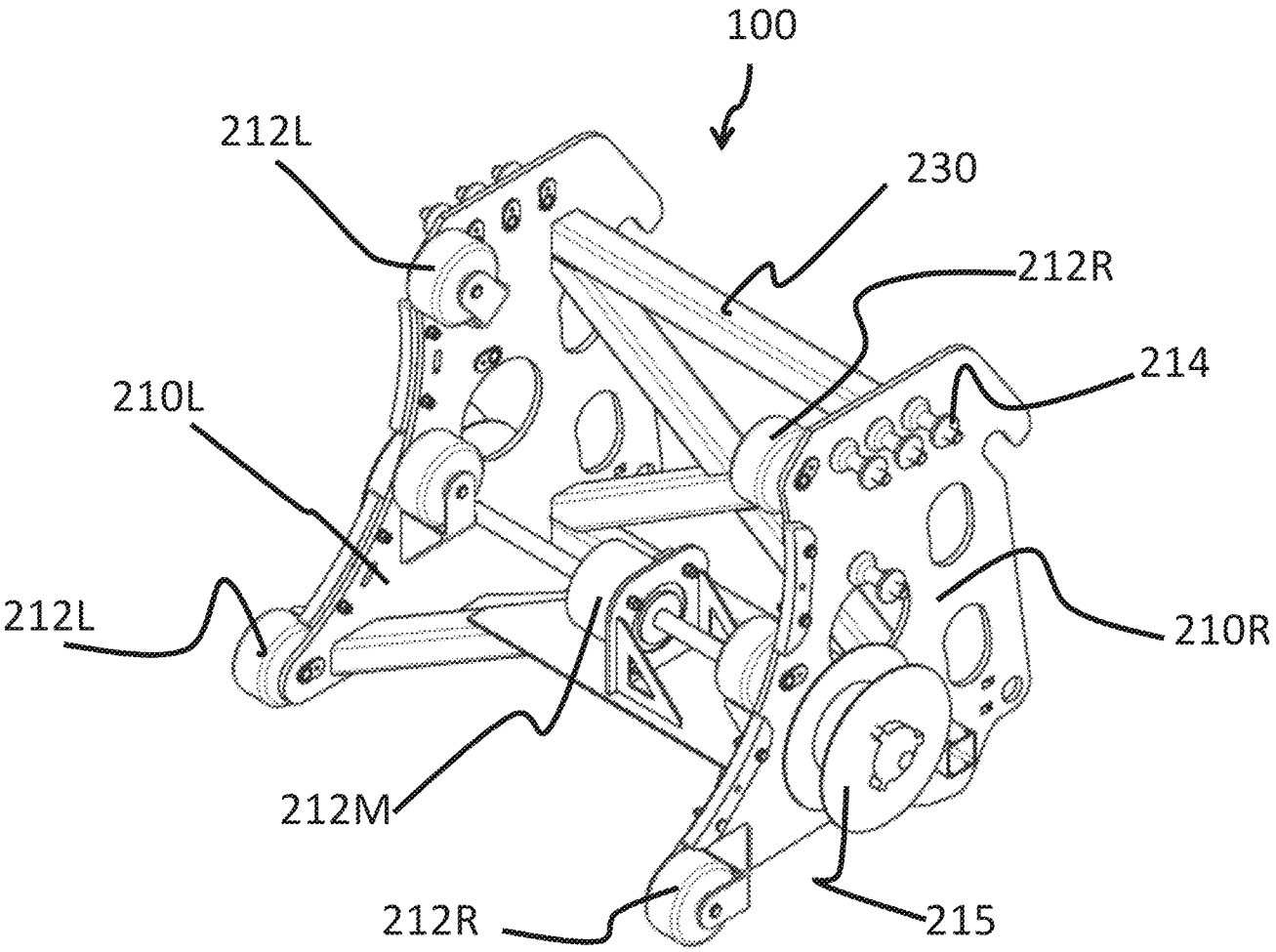
FIG. 15 is a view of the system as shown in FIG. 13 with the retaining means removed.
Figure 16:
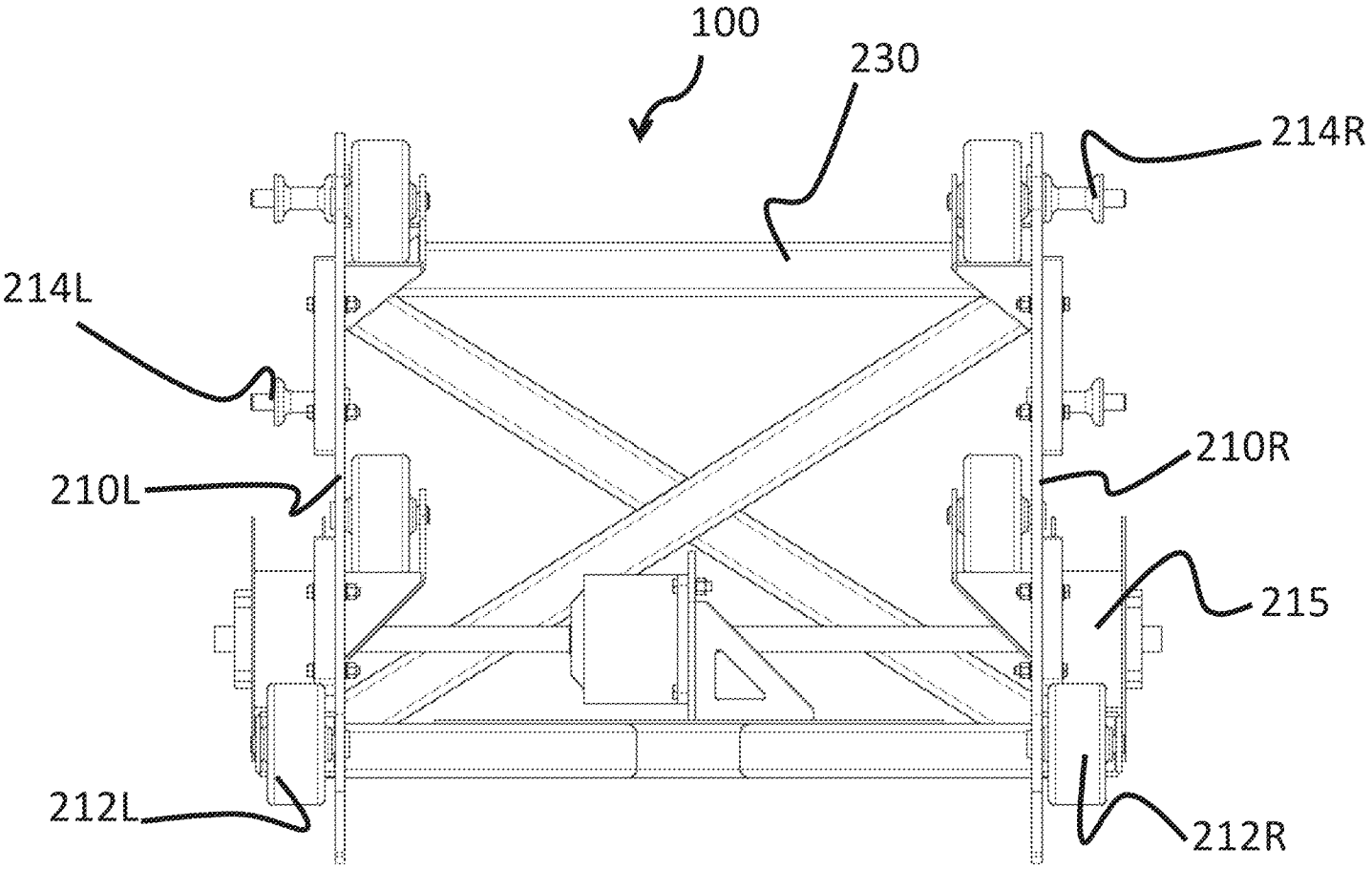
FIG. 16 is a side view of the system as shown in FIG. 15.
Figure 17:
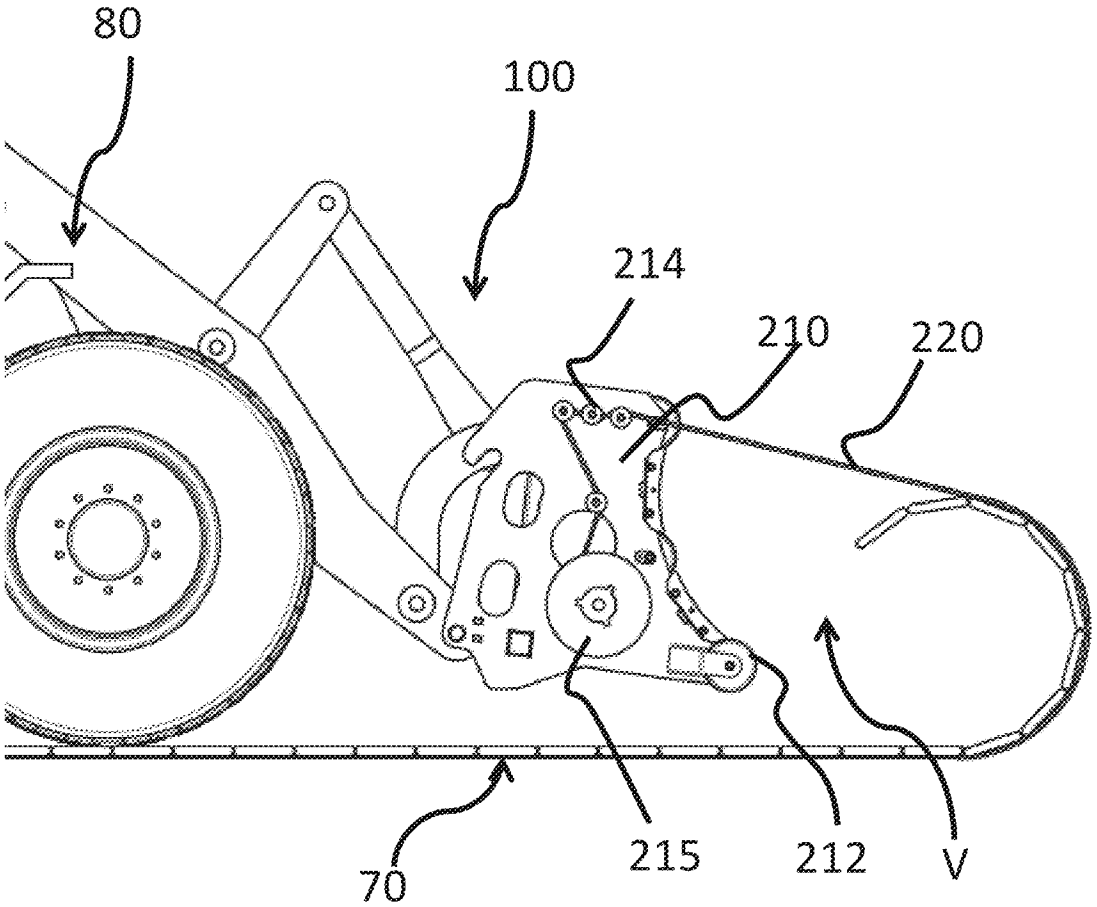
FIG. 17 is an illustration of the system according to an alternative embodiment of the present invention in use at the beginning of a recovery phase or end of a deployment phase.
Figure 18:
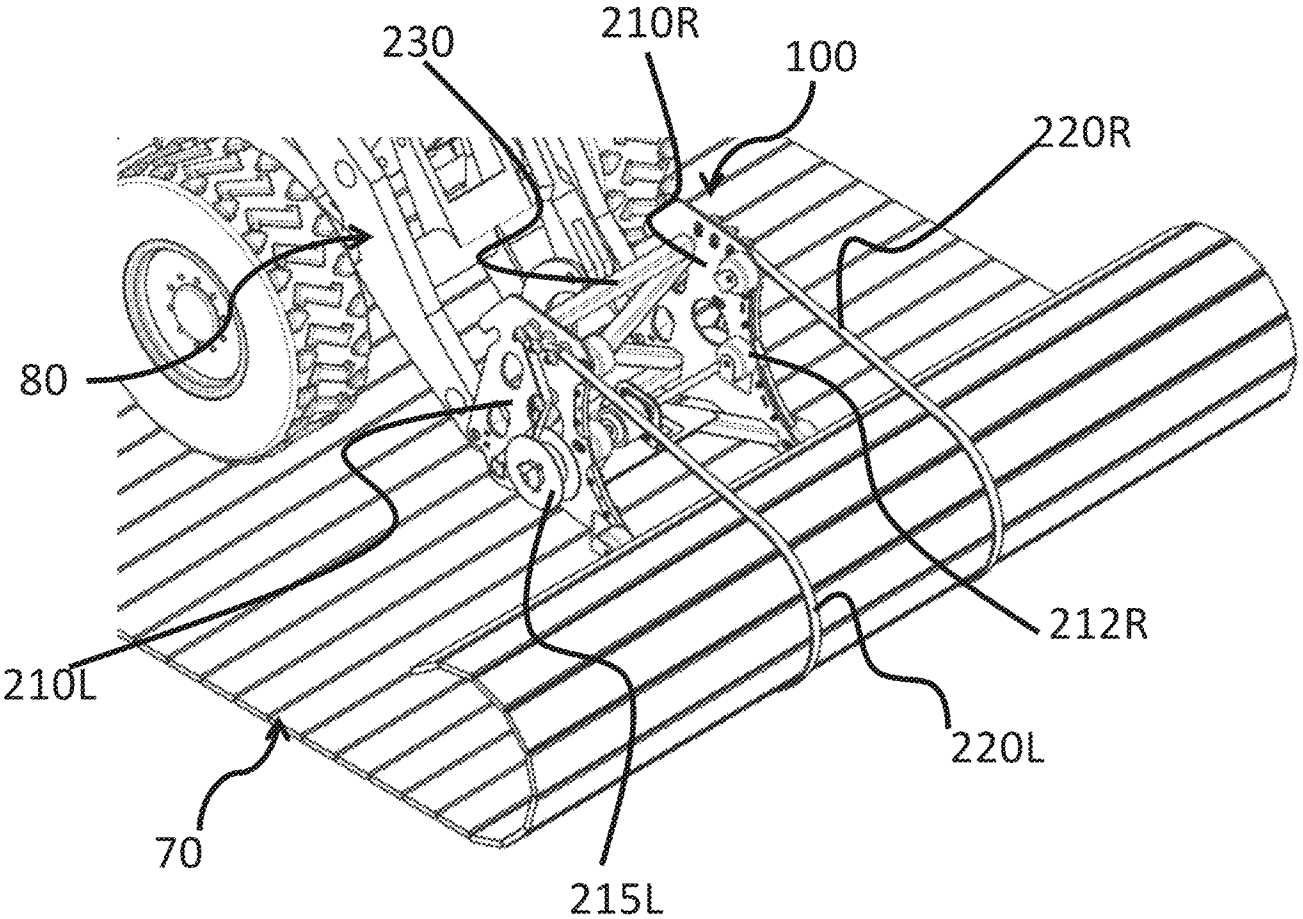
FIG. 18 is an isometric view illustration of the system as shown in FIG. 17.
Figure 19:
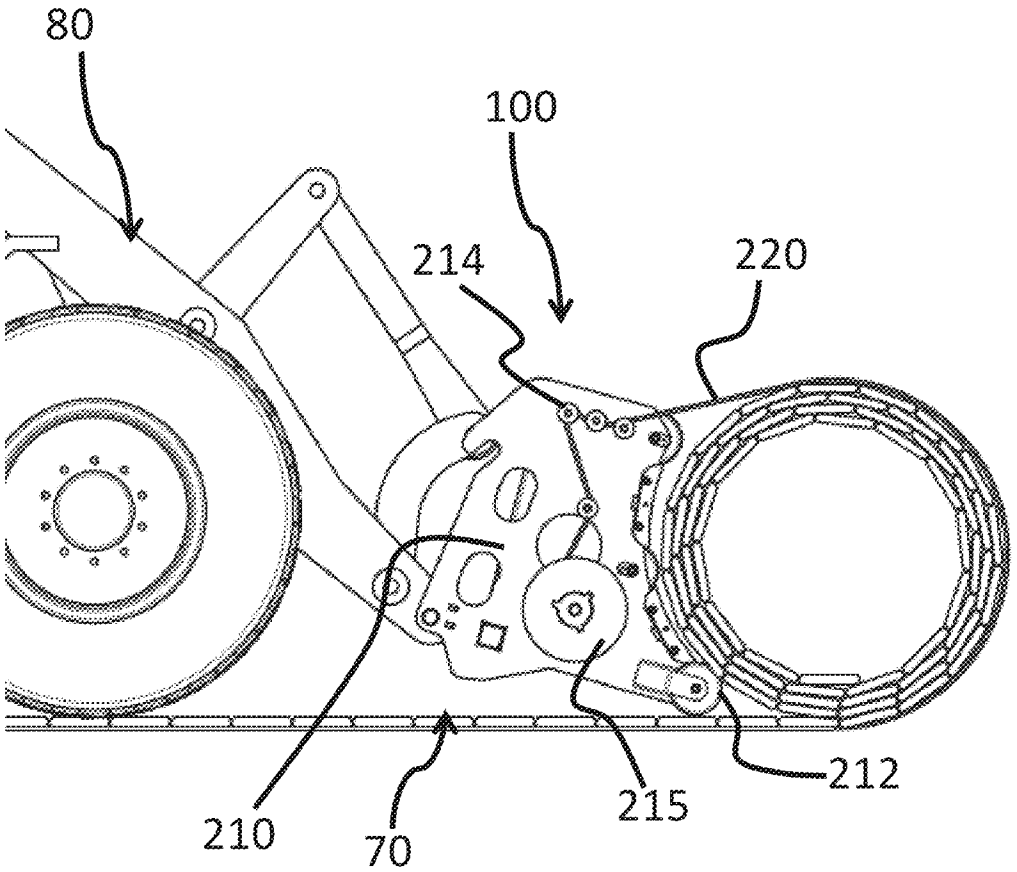
FIG. 19 is an illustration of the system as shown in FIG. 17 in use at a recovered phase or an un-deployed phase; and, FIG. 20 is an isometric view illustration of the system as shown in FIG. 19.
Figure 20:
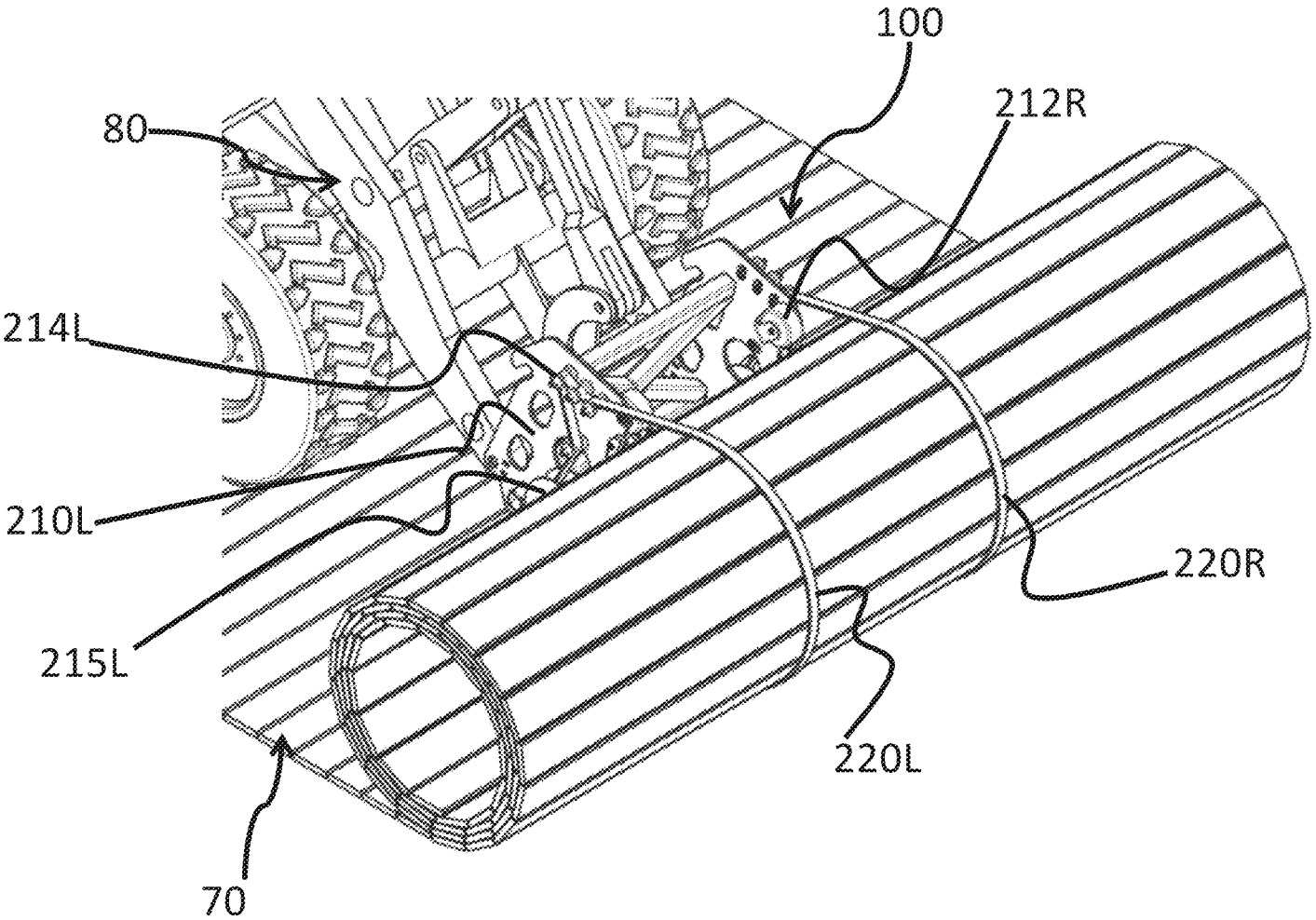

FIGS. 15 and 16 show the spool-less system (100) shown in FIGS. 13 and 14 without the strap (220).

Shown in FIGS. 17 to 20 are views of an alternative embodiment of the system (100) including straps (220) attached to a host machine (80) and loaded with a track roll (70), in different stages of deployment, recovery, manipulation and transportation.

In an example of use of the alternative embodiment, the system (100) accommodates four main uses; deployment, recovery, manipulation and transportation. During deployment, the system is oriented so as to entrap the roll (70) inside the volume of influence (V). At this point the host machine drives forward, allowing the push-rollers (212) to apply a pushing force to the roll, while the straps (220) are partially unwound to release the roll. Importantly, the rollers provide a force while minimising roll resistance as would be present if using a simple beam or pad. The host machine then drives out the roll, with braking/stop functionality provided by the straps (220). During recovery: the straps are wound back in, while the host machine, being on the road panel mat itself also reverses. The straps act in a parbuckle arrangement to recover the roll. The strap winds in such that the track panel (70) contact the guide member (210), which follows the curvature of the member downward supported by the rollers (212). Once the first wrap has been established, the host vehicle needs only reverse and continue to wind in the strap to recover the rollable road panel mat. During manipulation: the volume (V) is collapsed inwardly, the straps (220) are wound around the drums (215) reducing the distance between the guide member (110) and retaining means (120) which in effect grabs the roll in its entirety. Additionally a further locking means (not shown) such as fold over forks or knots, can be used to secure the roll. This grab function provides the ability to lift and move the roll as needed, including for storage or loading onto flatbeds, frames, stillages etc. This greatly improves the flexibility of deployment options open to the user. During transportation: when the system (100) is required independently of the host machine (80), the system can be constructed to be foldable so as to reduce the volume and footprint required to move the system. This is achieved whereby the mounting frame, guide members and straps, which are integral to creating the volume of influence can be unlocked and rotated to a park position. This effectively allows the whole assembly to concertina down to a flat package, allowing the dimensions to be configured to standard modes of transport (ISO containers, 463L air freight, etc.)

Importantly, as shown in the embodiments, while the system is coupled to a host machine, the host machine may recover and deploy the track roll while the machine is located on a portion of the track. For example, the track can be deployed as the host machine travels in a first direction, such as forwardly, with the host machine traveling upon the deployed track, thereby avoiding the need for the machine to traverse uneven terrain during the deployment. Similarly, the system allows the track to be recovered as the host machine travels in a second direction such as by reversing upon the deployed track, again avoiding the need for the machine to traverse uneven terrain during the recovery. It is to be appreciated however, that the system may also be located at a rear of the machine, such that the track may be deployed as the machine reverses and recovered as the machine moves forwardly. In this situation, the machine again travels upon the track during the deployment and recovery of the track.

Select embodiments of the invention only have been described and illustrated, and it will be readily apparent that other embodiments, modifications, additions and omissions are possible within the scope of the invention.

The apparatus of the invention may be varied according to requirements, including but not limited to physical dimensions or construction materials, having as its objective the provision of system for spool-less deployment, recovery and manipulation of rollable roadway panels.

INDEX

100. system
110. guide member
111. guide arm
112. rollers
113. body
120. retaining means
121. distal arm portion
122. rollers
123. body
130. mounting frame
140. connection means
150. arm actuator
160. diameter limiting member
161. diameter limiting actuator
200. alternative embodiment
220. strap
214. strap guide
215. drum
80. host machine
70. track roll
V. volume
L. first
R. second

The invention claimed is:

1. A spool-less system (100) for deployment, recovery and manipulation of a traversable road covering track, the system being detachably coupleable to a host machine (80) for providing operating power and transportation, the system comprising:

a retaining means (120); and an arcuate guide member (110) detachably couplable to the retaining means (120);

the guide member and retaining means defining a volume (V) for receiving a roll of traversable road covering track (70); the guide member being arranged to contact the roll along a first arcuate range and the retaining means configured to contact the roll along a second arcuate range; and wherein the guide member (110) and retaining means (120) have a first position in which the guide member and retaining means are separated by a first diameter, whereby the roll of traversable road covering track may be deployed or recovered when the host machine is in motion, and a second position in which the guide member and retaining means are separated by a second diameter in which the roll of traversable road covering is retained;

wherein the retaining means (120) comprises a plurality of rollers (122) configured into an arcuate array, the plurality of rollers disposed on a body (123) defining a distal arm portion (121); and wherein the distal arm portion (121) further comprises a diameter limiting member (160) configured to contact the roll of traversable road covering until the roll of traversable road covering is fully deployed.

2. The system of claim 1 wherein, the system further comprises a mounting frame (130) detachably coupleable to the host machine (80) and detachably coupleable to the arm (111).

3. The system of claim 2 wherein, the mounting frame (130) comprises a substantially horizontal elongate member.

4. The system of claim 3 further comprising a second arm (111R).

5. The system of claim 4 wherein, the first arm (111L) and second arm (111R) are located towards opposite horizontal ends of the mounting frame (130).

6. The system of claim 1, further comprising a connection means (140), connecting the guide member (110) with the retaining means (120).

7. The system of claim 6, wherein the connection means (140), comprises a pivot point (141) around which the second arcuate member rotates, thereby varying the diameter of the volume.

8. The system of claim 6, further comprising an arm actuator (150) to actuate the retaining means (120) and thereby the system into the first position and the second position.

9. The system of claim 7, wherein the diameter limiting member (160) is pivotally attached to an inner surface of the distal arm portion.

10. The system of claim 8, wherein the diameter limiting member (160) further comprises a limiting member actuator (161) to actuate the pivoting motion.

11. The system of claim 8, wherein the diameter limiting member (160) is resiliently biased to provide a consistent pressure against the roll of traversable road covering.

12. The system of claim 1 wherein, the retaining means (120) comprises a length of strap (220) detachably coupleable to the roll of traversable road covering.

13. The system of claim 10 wherein, the guide member (110) further comprises strap guides (224) for locating the strap.

14. The system of claim 11 further comprising a drum (215) connectable to the strap (220) and around which the strap may be wound.

15. A host machine (80) having mounted thereon the spool-less system (100) according to claim 1, the spool-less system being arranged to deploy a traversable road covering track (70) while the host machine travels in a first direction upon the deployed traversable road covering track, and to recover the traversable road covering track while the host machine travels in a second direction upon the deployed traversable road covering.

16. A method of deployment, recovery and manipulation of a traversable road covering track comprising the steps:

detachably coupling the spool-less system (100) as claimed in claim 1 to a host machine (80); and operating the host machine to recover and deploy the traversable road covering track (70) while the host machine (80) travels upon at least a portion of the traversable road covering (70).

* * * * *